United States Patent [19]

Michels

[11] 4,180,169

[45] Dec. 25, 1979

[54] WINDOW DISPLAY SUPPORT FOR FINGER RINGS

[75] Inventor: Fausto Michels, Pregassona, Switzerland

[73] Assignee: Laniere S.A., Crissier, Switzerland

[21] Appl. No.: 853,509

[22] Filed: Nov. 21, 1977

[30] Foreign Application Priority Data

Dec. 1, 1976 [CH] Switzerland ..... 15170/76

[51] Int. Cl.[2] ..... A47F 7/02

[52] U.S. Cl. ..... 211/13; 206/566

[58] Field of Search ..... 211/13; 206/45.14, 566; 140/102.5, 106, 104

[56] References Cited

U.S. PATENT DOCUMENTS

| | | | |
|---|---|---|---|
| 483,399 | 9/1892 | Smith | 206/566 X |
| 886,608 | 5/1908 | Jersemann | 206/566 X |
| 1,486,629 | 3/1924 | Buchsbaum | 206/45.14 X |
| 2,324,310 | 7/1943 | McGovern | 206/566 X |
| 2,963,149 | 12/1960 | Bergh et al. | 206/566 X |
| 3,197,166 | 7/1965 | Sandler | 206/566 X |
| 3,253,286 | 5/1966 | Bacon | 140/102.5 X |
| 3,370,702 | 2/1968 | Rosen | 206/566 X |

*Primary Examiner*—Roy D. Frazier
*Assistant Examiner*—Robert W. Gibson, Jr.
*Attorney, Agent, or Firm*—Young & Thompson

[57] ABSTRACT

A support for the display of finger ring in a jeweler's window, comprises a base having a stepped upper surface and an integral flexible tongue capable of being bent back into U-shape to form an elastic clip to hold the ring to be displayed on a step of the base. The base is recessed below the tongue to receive a price label attached to the ring and has a forward portion on which the price is displayed. The base has holes for fixing it to the floor of the display window to impede theft. The support is of one-piece molded plastic construction.

2 Claims, 10 Drawing Figures

WINDOW DISPLAY SUPPORT FOR FINGER RINGS

The present invention relates to window display supports for ringer rings.

Synthetic resinous, one-piece window display supports for rings and goldsmiths articles are known and the use of same permit of showing the price and the features of the ring or the article displayed in an easily visible and a satisfactory way from the aesthetic point of view.

Some of the said supports can, in addition, be fixed to the base of the display window to obviate, during a theft, a large quantity of precious articles being rapidly taken away.

These supports of known type have the drawback that they are of complicated shape and require complicated stamping or moulding tools for their manufacture, and this adds substantially to the cost manufacture. The complexity is due mainly to the fact that said known supports must be provided with springs adapted to hold the ring or other article.

According to the present invention there is provided a window display support for finger rings which include a base with a stepped upper surface and an integral flexible tongue capable of being bent back into U-shape to form an elastic clip to hold the article to be displayed on a step of the base, the said base having a space below the tongue adapted to receive a price label attached to the article and a front part shaped so as to receive a label or a small plate indicating the price or other features of said article.

Preferably the top surface of the base has a single step tongue. Preferably also, said space opens into the top surface; of the base. Further, preferably, the base has bores for the fixing of the support to a support surface of a window in which the support is to be used. Still further, preferably a magnet for holding the support to an iron or other magnetic material display plate is fixed to the base.

According to another aspect of the invention there is provided a tool for bending the elastic tongue of the support, said tool comprising a handle having a bifurcated end, one branch of which is constituted by a cylindrical bar of diameter corresponding to the radius of the curved base of the U-shape when the tongue is bent to U-shape, and the other branch carries a transverse plate which engages the tongue as the tool is turned to bend the tongue to U-shape.

A support according to an embodiment of the invention, and a tool for setting the support, are illustrated in the accompanying drawing, wherein:

FIGS. 1, 2, 3, 4 and 5 respectively are a side view, a front view, a rear view, a plan and an underneath plan of the support;

Figure 6:
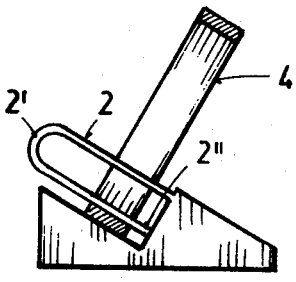
FIGS. 6 and 7 show the support in side view when holding a ring tag, the ring being shown in section in FIG. 6, and the support and ring being shown in section in FIG. 7.
Figure 7:
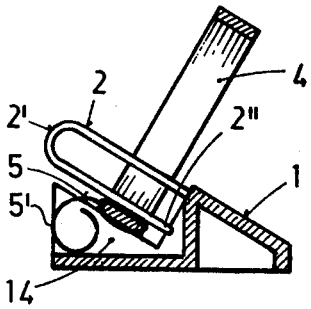

Referring to the drawing, the support which is preferably of one-piece construction of resilient resin, is fabricated in a single stamping or moulding operation and comprises the base 1 having a stepped upper surface defining a single step 13 and riser 13' and integral with riser 13' a substantial distance from step 13 is an upper tongue 2 which, being of flexible material may be turned or bent as indicated in FIG. 6 to form a spring clip 2' of U shape to hold the ring 4 (see FIG. 7). The tongue 2 thus bent therefore makes the spring for retaining the ring.

The recess or space 14 opens to the top surface of base 1 and serves to receive the label 5 which in this example is shown as being of coiled shape 5' shown clearly in the section of FIG. 7.

The front of the base 1 has a region 10 for receiving a plate or stamp or the like indicating the price or other features of the ring.

Figure 9:
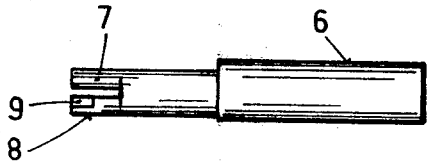
FIG. 9 shows in a side view, a tool which serves to bend the elastic tongue of the support of FIGS. 1 to 8.
Figure 10:
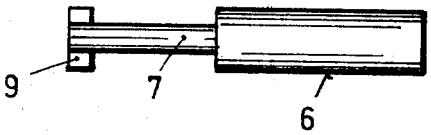
FIG. 10 shows the tool of FIG. 9 in plan.

To effect the bending of the tongue 2 the tool illustrated in FIGS. 9 and 10 may be used. The tool has a bifurcated end defining the tool fork branches 7 and 8. The first branch 7 is constituted by a cylindrical bar having the diameter corresponding to the radius of the curved base section of the U shape of the tongue 2 when bent to U-shape (FIG. 7) whilst the second branch 8 has the small transverse plate 9 which serves to engage the tongue 2 when the tongue 2 is engaged between branches 7 and 8 and a rotary motion is imparted to the tool 6, the tongue being wrapped round the branch 7.

Figure 5:
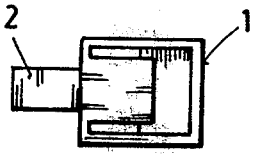
Figure 2:
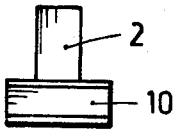
Figure 1:
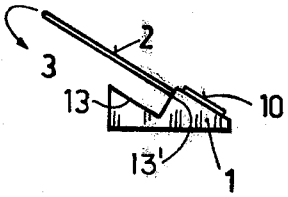
Figure 3:
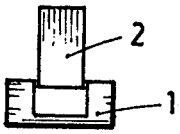
Figure 4:
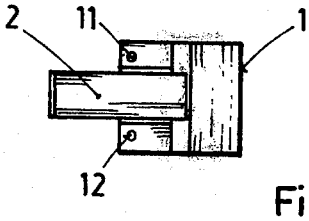
Figure 8:
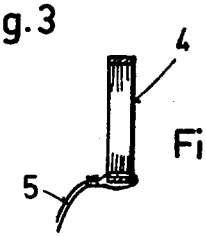
FIG. 8 shows in section how a ring is provided with a band of plastic material carrying the price and forming the price tag.

In base 1 may be made holes 11 and 12 (FIG. 4) to be able to fix the base on the surface of the base of the window to render theft more difficult and laborious.

Finally the support in question may be made also of slightly different form and also of nonresinous material but of a material ensuring that the tongue can be bent elastically without departing from the scope of protection of the patent.

What we claim is:

1. A window display support for finger rings including a base with a step and a riser on its upper surface and a flexible tongue secured to the upper portion of the riser and extending in its undeformed condition upwardly rearwardly from said riser a substantial distance from said step, said tongue being capable of being deformed into a U shape to form an elastic clip to hold the ring to be displayed on said step of the base.

2. A support as claimed in claim 1, in which said tongue is integral with said upper portion of the riser.

* * * * *